US011389812B2

(12) United States Patent
Meisner

(10) Patent No.: US 11,389,812 B2
(45) Date of Patent: Jul. 19, 2022

(54) MEASURING AND MIXING DEVICES

(71) Applicant: BASF COATINGS GMBH, Münster (DE)

(72) Inventor: Roland Meisner, Senden (DE)

(73) Assignee: BASF Coatings GmbH, Muenster (DE)

( * ) Notice: Subject to any disclaimer, the term of this patent is extended or adjusted under 35 U.S.C. 154(b) by 220 days.

(21) Appl. No.: 16/642,519

(22) PCT Filed: Aug. 15, 2018

(86) PCT No.: PCT/EP2018/072102
§ 371 (c)(1),
(2) Date: Feb. 27, 2020

(87) PCT Pub. No.: WO2019/042772
PCT Pub. Date: Mar. 7, 2019

(65) Prior Publication Data

US 2020/0188944 A1 Jun. 18, 2020

(30) Foreign Application Priority Data

Sep. 1, 2017 (EP) ..... 17189066

(51) Int. Cl.
*B05B 7/24* (2006.01)
*B05C 17/005* (2006.01)
*B05C 17/015* (2006.01)

(52) U.S. Cl.
CPC ..... *B05B 7/2472* (2013.01); *B05B 7/241* (2013.01); *B05B 7/2481* (2013.01); *B05C 17/00513* (2013.01); *B05C 17/00559* (2013.01); *B05C 17/015* (2013.01)

(58) Field of Classification Search
CPC ..... B05B 7/0408; B05B 7/2472; B05B 7/241; B05B 7/2481; B05B 11/02; B05C 17/00513; B05C 17/00559; B05C 17/015
USPC ..... 239/303, 322, 346, 432
See application file for complete search history.

(56) References Cited

U.S. PATENT DOCUMENTS 4,493,436 A 1/1985 Brokaw
4,690,306 A 9/1987 Stäheli
6,311,871 B1 11/2001 Binder
6,705,539 B1 * 3/2004 Bien ..... B05B 7/0408 239/432

(Continued)

FOREIGN PATENT DOCUMENTS

CN 1743081 A 3/2006
CN 101417270 A 4/2009

(Continued)

OTHER PUBLICATIONS

European Search Report for EP Patent Application No. 17189066.8, dated Feb. 27, 2018, 3 pages.

(Continued)

*Primary Examiner* — Steven J Ganey
(74) *Attorney, Agent, or Firm* — Armstrong Teasdale LLP

(57) ABSTRACT

The invention relates to a measuring and mixing device including a cartridge holder (1) and a cartridge (2), a flat, at least form-fit connection being mounted between the cartridge and the cartridge holder. The invention also relates to a method for coating substrates with two or multi-component coating agents, in which the measuring and mixing device is used.

17 Claims, 11 Drawing Sheets

(56) References Cited

U.S. PATENT DOCUMENTS

| | | | | |
|---|---|---|---|---|
| 7,717,357 | B2 * | 5/2010 | Gantenbein | B05B 9/04 239/432 |
| 7,878,425 | B2 * | 2/2011 | Handzel | B05B 7/241 239/346 |
| 2001/0038039 | A1 * | 11/2001 | Schultz | B05B 13/0421 239/1 |
| 2004/0129122 | A1 | 7/2004 | Brugner et al. | |
| 2006/0043118 | A1 | 3/2006 | Law et al. | |
| 2009/0101677 | A1 | 4/2009 | Rossignol | |
| 2012/0104044 | A1 | 5/2012 | Pappalardo | |
| 2013/0154158 | A1 | 6/2013 | Decottignies et al. | |
| 2018/0200741 | A1 * | 7/2018 | Moews | B05B 7/241 |

FOREIGN PATENT DOCUMENTS

| | | | |
|---|---|---|---|
| CN | 201524634 | U | 7/2010 |
| CN | 102553747 | A | 7/2012 |
| CN | 103068547 | A | 4/2013 |
| CN | 205684285 | U | 11/2016 |
| DE | 3031798 | A1 | 4/1982 |
| DE | 102010019220 | A1 | 11/2011 |
| EP | 2353733 | A1 | 8/2011 |
| GB | 2246172 | A | 1/1992 |
| GB | 2276365 | A | 9/1994 |
| WO | 9313872 | A1 | 7/1993 |
| WO | 2013104771 | A1 | 7/2013 |
| WO | 2016020129 | A1 | 2/2016 |
| WO | 2016180863 | A1 | 11/2016 |

OTHER PUBLICATIONS

International Search Report and Written Opinion for corresponding International Application No. PCT/EP2018/072102, dated Oct. 11, 2018, 14 pages.

* cited by examiner

MEASURING AND MIXING DEVICES

CROSS-REFERENCE TO RELATED APPLICATIONS

The present application is a U.S. National Application of PCT/EP2018/072102, filed on Aug. 15, 2018, which claims the benefit of priority to European Patent Application No. 17189066.8, filed Sep. 1, 2017, the entire contents of which are hereby incorporated by reference.

The present invention relates to metering and mixing devices which comprise multichamber cartridges. The invention furthermore relates to a method for delivering, metering, mixing and/or applying multicomponent systems using the metering and mixing devices according to the invention.

Multicomponent systems in the sense according to the present invention are systems, the individual components of which are stored separately before application and are mixed with one another in the required proportions only immediately before application. Examples of typical multicomponent systems are coating media which cross-link at room temperature, e.g. paints, but also many sealing compounds or adhesives. In the sense according to the present invention, however, systems in which the individual components do not react chemically with one another but in which changes in the physical properties occur after the mixing of the components are also regarded as multicomponent systems. For example, these can be increases in viscosity, without the need for a chemical cross-linking reaction to take place, after the mixing of two low-viscosity components.

The prior art therefore includes various mixing devices, and these are embodied in different ways for the respective uses. Thus, mixing devices of the kind used in painting processes, especially spray painting processes, are often very different from those used for adhesives and sealing compounds of the kind sold in many hardware and DIY stores, for example. With these, the material is discharged from the cartridge by means of plungers, i.e. pistons that can be moved by positive engagement. Since the mixing devices in the present invention are suitable for universal application, the prior art outlined below will include both the area of spray painting processes and that of adhesive and sealing compound application.

Spray painting processes are widely used in industrial and commercial paint shops without electrostatic charging of the paint, for example. The processes are distinguished from other painting processes especially in that they can be used manually, offer high flexibility in respect of the shape, size and materials of the objects to be painted as well as the selection of paint and the changing of the paint, allow mobile use and involve relatively low investment costs (H. Kittel, "Lehrbuch der Lacke und Beschichtungen" ["A Textbook of Paints and Coatings"], Second Edition, Volume 9, page 26-40; S. Hirzel Verlag Stuttgart Leipzig, 2004).

Spray painting processes can be divided essentially into high-pressure or low-pressure compressed air spraying processes, on the one hand, and airless spraying, with or without air assistance, on the other.

Pneumatic atomization or compressed air spraying was the first spray painting process to be developed, around 1900. Compressed air atomization is still the most frequently used process in industry and commerce today. In the high pressure spraying process, also referred to as conventional spraying or pneumatic spraying, the air pressure used is generally about 2 to 7 bar, while, in the case of low-pressure spraying, also referred to as HVLP ("high volume, low pressure" spraying or spraying with a high spray volume flow and a low pressure), the air pressure used is generally 0.2 to 0.7 bar (H. Kittel, ibid.).

At the atomizer head, the compressed air flows out of an annular opening, which is formed by a central hole in the air cap and the paint nozzle arranged therein. Additional air jets from various air cap holes are used to regulate the shape of the jet and to assist atomization. The compressed air, which flows out at high speed, results in a low-pressure zone directly at the paint nozzle orifice, and this assists the outflow of the paint, especially in the case of unpressurized paint feed from a "suction cup", by means of the suction effect thereof (H. Kittel, ibid.).

Apart from delivery of the paint material from a suction cup, there is also the possibility of feeding the paint material to the spray gun nozzle by means of delivery systems such as flow cups, pressure vessels or recirculation systems, depending on the quantity required and the viscosity. First of all, therefore, it is possible to feed the paint by means of a suction cup system, this being accomplished by means of the suction effect of the spraying air, as explained above. Typical cup volumes are up to about one liter. Likewise possible is the flow cup system, wherein here the paint is fed in both by means of the suction effect of the spraying air and also with assistance by the pressure due to the paint head. In this paint delivery system too, cup volumes of about one liter are generally not exceeded. The pressure system and the recirculation system are likewise known as paint delivery systems. In the pressure system, the paint is fed in from a pressurized tank by assistance from a pressure of 0.5 to 4 bar (conventional tank volume 1 to 250 liters). In the recirculation system, paint from an unpressurized tank is pumped back into said tank via a ring line by piston or turbine pumps. The required ring line pressure is set by means of a pressure holding valve (return control valve). Typically, the use of recirculation systems is worthwhile only in the case of a daily consumption of more than 100 liters of paint (H. Kittel, ibid.).

Two-component coating media (2C coating media) are predominantly processed using spraying methods owing to the time-limited processing time (pot life) thereof. Here, the central problem is the metering of the masterbatch and the hardener. In the case of small batches and individual parts, particularly in the area of refinish coating as well, e.g. automotive refinish coating, the 2C material is generally mixed manually in the predetermined ratio and sprayed like a single-component material. In practice, this means that both the metering and mixing of the components takes place before the filling of a flow cup or suction cup or in the flow cup or suction cup itself, and therefore the quality and homogeneity of the mixture also very much depends on the manual skill of the painter. Unused material must be discarded after the pot life has expired. On the other hand, quick drying and hardening behavior of the paint film is desired, for which reason hardening catalysts are often incorporated into the masterbatch and/or hardener of the 2C or multicomponent mixture.

Precisely when using 2C or multicomponent coating media, there is therefore a desire for a long processing or pot life but with, at the same time, improved drying and rapid hardening of the paint film sprayed on.

In order to obtain the best possible appearance of the hardened paint film and reproducible quality levels, it is absolutely essential to produce masterbatch and hardener compositions which are as far as possible homogeneous and of constant high quality and which have constant properties over the entire period of application. It is precisely in the case of premixed 2C systems that this is not always the case, when, for example, a short pot life leads to the initially sprayed material having a low viscosity owing to the fact that the reaction of the constituents has not yet progressed, while the remaining material sprayed at a later stage already to some extent contains viscosity-increasing cross-linking products.

In the production of large numbers of items, with short pot lives and high quality requirements, highly specialized metering and mixing systems are used in the industry in order to maintain tolerance limits of +/−5% of the hardener volume, relative to the masterbatch quantity, for the accuracy of metering. Further developments aim at pulsation-free metering and low wear on the system, by using diaphragm-type metering devices, for example. Paint delivery systems with pressure-controlled gear pumps are also known. In multicomponent systems, the delivery rates of the individual gear pumps are matched to one another. For mixing, static or dynamic systems with driven mixing units are used. Special guns, in which the masterbatch and the hardener are dispensed from separate nozzles and the droplets formed mix in the spray jet, are also used in the case of very short pot lives (H. Kittel, ibid.).

However, it is precisely in small paint works that there is a need for significantly less expensive delivery, metering and mixing devices. In particular, it should not be necessary to use the above-mentioned special guns or highly specialized metering and mixing units. The simplicity of using suction cups or flow cups should be retained. Delivery, metering and mixing should be accomplished solely by the application of pressure. There should be no need for an additional external drive for delivery, metering or mixing. In particular, there should be no need for driving by pumps and the like. Nevertheless, the capacity for processing virtually independently of pot life should be retained while simultaneously ensuring homogeneous mixing of the components before they reach the nozzle of the spray gun and preferably the spray gun itself or that of some other application device. The paint films obtained should dry well and harden quickly and should lead to hardened films with a good appearance.

WO 93/13872 A1 describes a method for applying a multicomponent refinish coating composition, in which at least two paint components are held in separate containers and at least one component is fed under pressure to a kinetic metering system, which comprises two double acting cylinders attached to pistons and having cylinder rods. The metered components are fed to a mixer, which opens into a paint spray gun. The construction of the metering device is rather complex.

WO 2013/104771 A 1 discloses an apparatus for delivering, metering and mixing liquid paint components, comprising a paint feeding device, which comprises two or more paint-supply containers, each with at least one outlet opening for different paint components which are to be mixed with one another; or comprises one paint-supply container comprising two or more chambers for different paint components which are to be mixed with one another, wherein each chamber has at least one outlet opening. The apparatus furthermore comprises a metering apparatus, which is arranged downstream of the paint-feeding apparatus and has a number of inlet openings for the paint components which corresponds to the number of outlet openings of the paint-supply containers or of the paint-supply container, wherein the metering apparatus is configured in such a way that the volume flows of paint components to be mixed which enter via the inlet openings are forcibly delivered separately from one another via rotating delivery devices serving as metering units, and the delivery devices are connected to one another in such a way that their rotational speeds are fixed in relation to one another, and wherein the metering apparatus has separate exit openings for the now metered volume flows of the paint components. The apparatus furthermore has a static mixing apparatus, which is arranged downstream of the metering apparatus and has a number of entry openings for the metered volume flows which corresponds to the number of exit openings of the metering apparatus, and the discharge of said mixing apparatus being designed in such a way that it can be connected to a paint-spray gun.

A simple multichamber cartridge for mixing and applying multicomponent adhesives having at least two concentrically arranged chambers is described in GB 2 276 365 A.

DE 30 31 798 A1 likewise discloses a discharge device for multicomponent compounds, in particular multicomponent adhesive, sealing or filler compound having containers arranged adjacent to one another, which are separated from one another by partition walls extending parallel to the discharge device. Each container has a pressure piece assigned thereto, wherein the pressure pieces are connected to one another by a web that has a cutting edge which cuts through the partition walls of the containers during discharge. Here, the containers can be arranged coaxially with respect to one another, and the connection between the pressure pieces can be made by a web implemented as a piston rod, which can be actuated by means of a gas column, for example. Mixing of the components takes place in a chamber which adjoins the two containers in the form of a tip in the direction of pressure.

The metering gun described in EP 2 353 733 A1 makes use of a similar construction, although the cutting edges cut open the partition between the containers of the coaxial cartridge in a spiral. According to EP 2 353 733 A1, the discharge device according to DE 30 31 798 A1 has the disadvantage that the partition wall which has been cut open could prevent the piston from being pressed further down, and the spiral cut is intended to prevent this.

US 2004/0129122 attempts to solve the problem addressed in EP 2 353 733 A1 in a different way, namely by using a deflection plate to press the severed partition wall against the inner wall of the outer tube.

U.S. Pat. No. 4,493,436 describes a device which is similar to the two devices mentioned above but has chambers that are not arranged coaxially.

British Patent Application GB 2 246 172 discloses a complex structure of a two-chamber cartridge, in which a concertina-like construction of a chamber is implemented and the chambers are adjoined in the direction of pressure by a static mixer.

DE 10 2010 019 220 A1 discloses a cartridge system with connected delivery bodies, in particular for mixing and applying a medical-grade cement. The delivery pistons can be operated by gas pressure. However, a central mixing space illustrated in the figures of this document is closed on one side and can be used for mixing the components only to a limited extent, if at all. It in no way replaces the necessary mixing in the region of the outlet opening of the cartridge or sprayer. Moreover, the material chambers are very small owing to the required travel of the delivery pistons, and therefore there is poor utilization of the overall volume of the device by the cement components.

Common to all the above-mentioned devices is that they have mixing sections adjoining the direction of discharge from the material chambers which are embodied as simple mixing chambers or simple static mixers. All the mixing sections are either very short and not suitable for demanding mixing processes, such as the mixing of two- or multicomponent paints, and especially not for the automotive finish sector, or metering and mixing is complex. Precisely in this case, absolutely homogeneous mixing is a basic prerequisite for an outstanding appearance. However, adding long mixing sections would add considerably to the construction of the prior art cartridges, making them unwieldy for manual use.

International Application WO 2016/020129 A1, in contrast, discloses a metering and mixing device in which the mixing section is arranged within the device and precisely in such a way that it does not adjoin the direction of discharge from the material chambers. The device comprises a cartridge holder and a multichamber cartridge arranged therein. The mixing section already mentioned has static mixing elements and is arranged in the form of a tube in the central region of the device, either as part of the cartridge holder or of the cartridge. The mixing section is furthermore aligned coaxially with respect to the side walls of the cartridge holder and hence also to the side walls of the cartridge, which rests positively over a large area against the holder. Moreover, the actual cartridge has at least two chambers, which are likewise arranged coaxially with respect to the mixing section and from which corresponding components of a multicomponent system, e.g. a multicomponent paint, can be discharged counter to the direction of flow of the mixing section by means of air-operated pistons connected to one another by webs (cutting device). The components can then be transferred to the mixing section via a directional control valve and, finally, after mixing and in the mixed state, fed to an application device. By means of connection of the pistons established by cutting devices, the partition walls between two chambers are severed as the movement of the piston begins, and a continued movement of the pistons is thus made possible. The already described positive contact between the lateral cartridge wall and the lateral cartridge holder wall allows sealing, thus making possible the above-described piston movement initiated by compressed air.

In particular, the device described ensures precise metering of components of multicomponent systems, even if these each have a different viscosity. Moreover, a compact overall construction is obtained, and nevertheless a comparatively long mixing section and hence effective mixing of components is achieved. In sum, the device obtained already meets many requirements in respect of manual painting using multicomponent systems.

However, it is a significant feature of the objects described in WO 2016/020129 A1 that the large-area outer wall (side wall) of the cartridge rests positively against the inner wall of the cartridge holder. In this case, said inner wall of the cartridge holder and hence also the side wall of the cartridge have a preferably cylindrical shape. Thus, the cartridge holder is set up in such a way that the entire cartridge or the majority of the cartridge can be introduced positively into the holder. The holder can also be closed by means of a cover for fixing the cartridge, for example, or the cartridge itself can be connected in the upper region to the holder by means of a reversible joint-type connection.

The disadvantages resulting from this design can be summarized as follows.

The complete or almost complete and, in particular, positive introduction of the cartridge into the holder, which must generally be performed by hand, is relatively complicated. Introducing the cartridge even at only a slight angle can lead to catching and jamming. The introduction process is therefore difficult to manage.

Closing the holder by means of a separate cover, e.g. by means of a bayonet joint or a screw-threaded joint, involves another step in putting the device into operation. Moreover, the separate cover entails a further, individual and therefore complicating component part. An alternative possibility to this is the direct joint-type connection of the cartridge and the holder. In this context, however, difficult handling is once again involved. This is because the positive contact between the cartridge and the holder makes rotation of the two component parts relative to one another, as is necessary for conventional closing principles, very difficult to carry out.

In addition, WO 2016/020129 A1 furthermore also explicitly discloses only a strictly cylindrical shape for the outer wall (side wall) of the cartridge and the inner wall of the cartridge holder. This is not surprising, simply because of the difficulties described in inserting the cartridge positively into the holder. Chamfering and hence a more complex geometry of the component parts would make insertion even more complex. However, this also means that it is not possible, in accordance with WO 2016/020129 A1, to implement corresponding demolding chamfers. However, such demolding chamfers are extremely advantageous in the context of the normally employed production process for cartridges that form the subject matter here, namely the process of injection molding plastic. Consequently, the production process for the cartridge according to WO 2016/020129 A1 tends to be somewhat difficult and therefore more expensive.

Another disadvantage of the device is the somewhat complex problem of marking the cartridge. Thus, owing to the positive contact between the cartridge in the holder, it is only with difficulty that the large-area outer wall (side wall) of the cartridge can be labeled with a label (also referred to as a body label) and that a cartridge labeled in this way can be introduced into the overall device. The label will generally be too thick and/or may crease during the process of introduction, thus making effective sealing for pressure buildup or even the introduction of the cartridge impossible. There is then only the possibility of applying small labels, which have to be glued on in positions which are less easily visible. However, in many areas of industry in which corresponding multicomponent systems are to be used, it is necessary to adequately label materials and, at the same time, also to provide hazard or safety symbols and explanations, for example. It is only with difficulty that this can be achieved on small labels.

There is therefore a requirement for a metering and mixing device, in particular for multicomponent systems, which no longer has the disadvantages of the prior art. Accordingly, there would be an advantage in a device which can be assembled and correspondingly also disassembled very easily by means of the connection of the cartridge and cartridge holder, preferably including a screw-threaded joint, and which furthermore has component parts that can have demolding chamfers, thus enabling them to be produced in a very effective manner by injection molding. Not least, it would be of advantage to enable labeling on generally large-area lateral surfaces of cartridges. At the same time, the metering and mixing device should, of course, also enable precise metering, a compact overall construction and furthermore effective mixing of components from multicomponent systems, i.e. ultimately should have the outstanding characteristics of the device described in WO 2016/020129 A1. It is precisely here that the object of the present invention has its starting point.

A metering and mixing device has been found, comprising, i. a cartridge holder (1) comprising
   (a) a receiving container (1.1) for multichamber cartridges (2), and
   (b) a compressed air connection (1.2) and a connection (1.3) for an application device, and ii. a multichamber cartridge (2) inserted into the cartridge holder according to i., wherein said cartridge comprises the following sections:

an upper section (2.1), comprising a directional control valve (2.1.1);

a central section (2.2), the center of which is designed as a space (2.2.1) which is extended in the direction of the longitudinal axis of the cartridge and is fitted with static mixing elements (2.2.1.1), and the space (2.2.1) is surrounded by at least two chambers (2.2.2), wherein the chambers are arranged so as to be extended in the direction of the longitudinal axis of the cartridge, and adjacent chambers are separated from one another by a common partition wall (2.2.4), and each chamber (2.2.2) is connected to the upper section (2.1) by in each case at least one opening (2.2.5); and a lower section (2.3), which comprises a piston (2.3.1) for each of the chambers, wherein the pistons (2.3.1) close off the chambers (2.2.2) leaktightly from below and are connected to one another by cutting devices (2.3.3), and the cutting devices (2.3.3) are arranged in such a way that they are capable of severing the common partition wall (2.2.4) of respective adjacent chambers (2.2.2) when the pistons (2.3.1) are moved in the direction of the upper section (2.1), wherein the multichamber cartridge (2) and the cartridge holder (1) have mutually complementary means (5) for the production of a reversible joint-type connection (6) between the cartridge and the holder, and wherein a surface-to-surface, at least positive connection including the entire circumference of the cartridge, which extends over a partial region of the upper section (2.1) and/or at least a partial region of the lower section (2.3) and/or only a partial region of the central section (2.2) of the cartridge, furthermore exists between the cartridge and the holder in the closed state of the reversible joint-type connection (6).

Accordingly, the present invention relates to the above-defined metering and mixing devices. The invention furthermore relates to a method for delivering, metering, mixing and/or applying multicomponent systems using a metering and mixing device according to the invention.

The attached FIGS. 1 to 6 serve to explain the present invention. The following reference signs are used:

(1) cartridge holder, (1.1) receiving container for multicomponent cartridges, (1.2) compressed air connection, (1.3) connection for an application device, (2) multichamber cartridge, (2.1) upper section of the multichamber cartridge, (2.1.1) directional control valve, (2.2) central section of the multichamber cartridge, (2.2.1) space extended in the direction of the longitudinal axis of the cartridge and fitted with static mixing elements, (2.2.1.1) static mixing elements, (2.2.2) chambers, (2.2.4) partition wall between adjacent chambers, (2.2.5) openings of the chambers of the central section of the multichamber cartridge toward the upper section of the multichamber cartridge, (2.3) lower section of the multichamber cartridge, (2.3.1) piston, (2.3.3) cutting device, (4) connection for flushing media, (5) or (5*a*) and (5*b*) means for producing a reversible joint-type connection between the holder and the cartridge, (6) reversible joint-type connection, (7*a*) region of surface-to-surface positive connection including the entire circumference of the cartridge, (7*b*) region of surface-to-surface positive and non-positive connection including the entire circumference of the cartridge, (A) interface in the partition wall between two adjacent chambers, (B) cut in the partition wall between two adjacent chambers.

Figure 1:
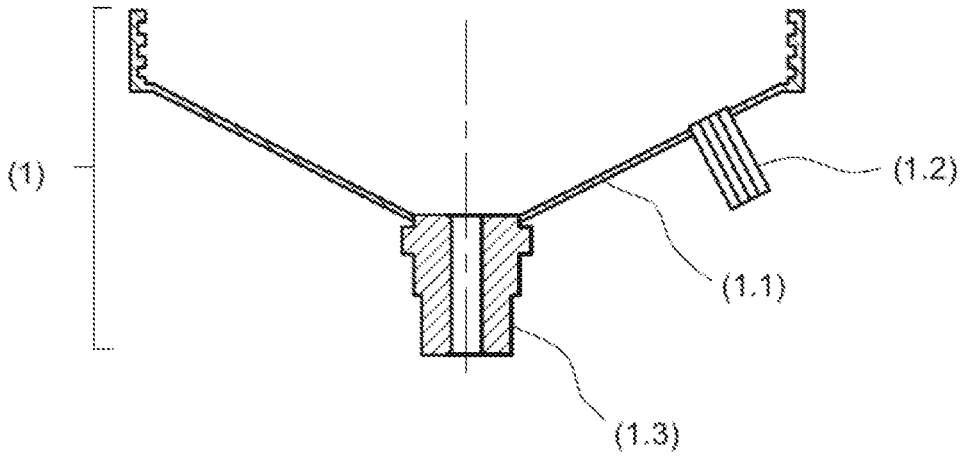
FIG. 1 shows a cartridge holder to be used according to the invention.
Figure 1A:
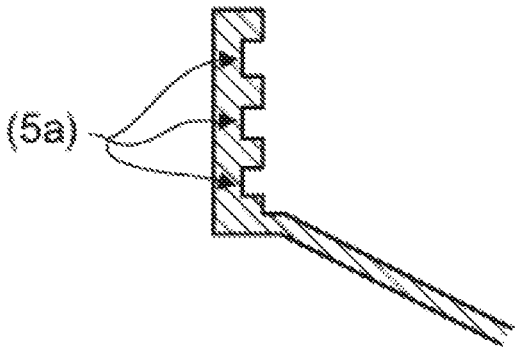
FIGS. 1*a* and 1*b* show detail views of regions of the cartridge holder comprising means (5*a*) for producing a reversible joint-type connection (6).
Figure 1B:
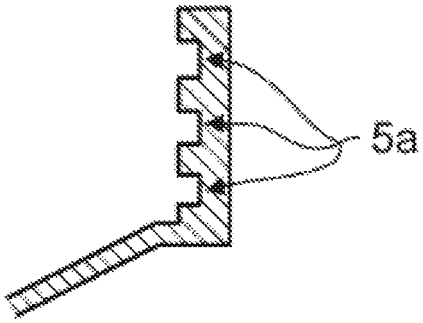
Figure 2:
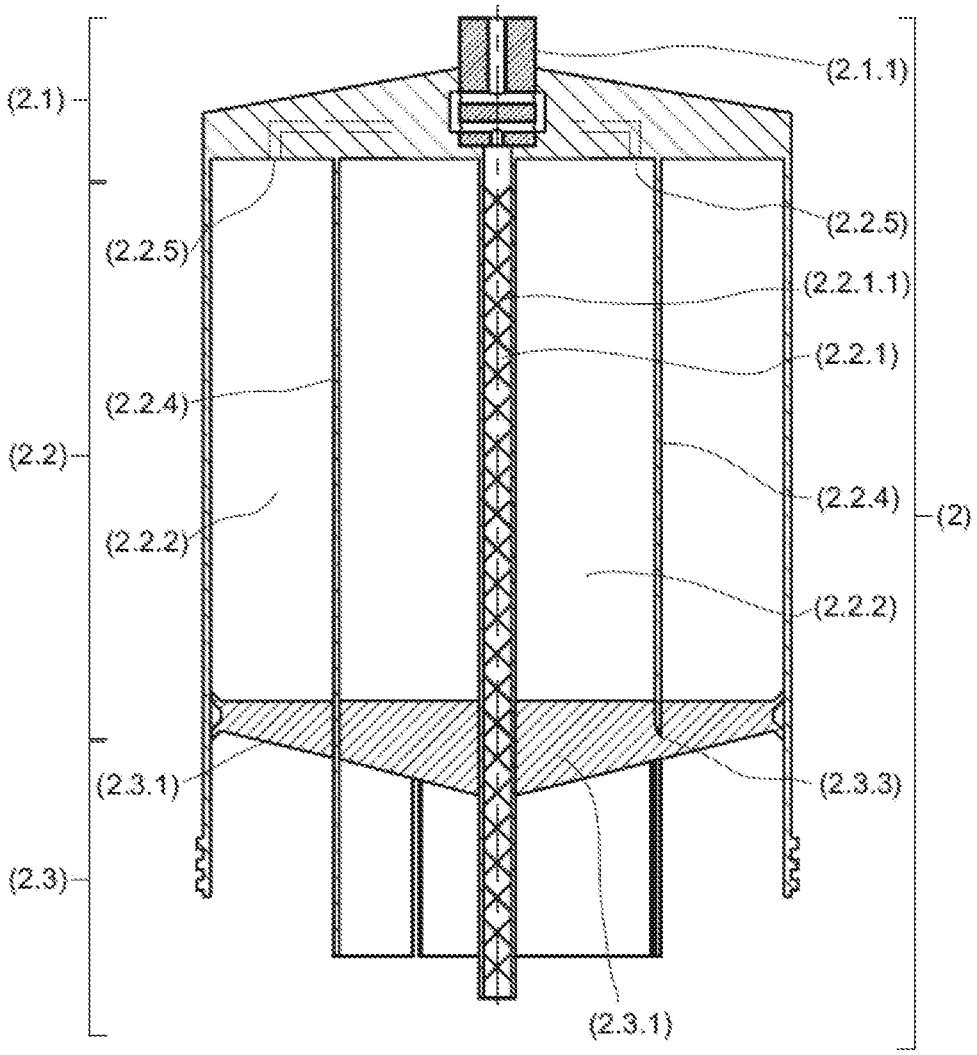
FIG. 2 shows a cartridge to be used according to the invention.
Figure 2A:
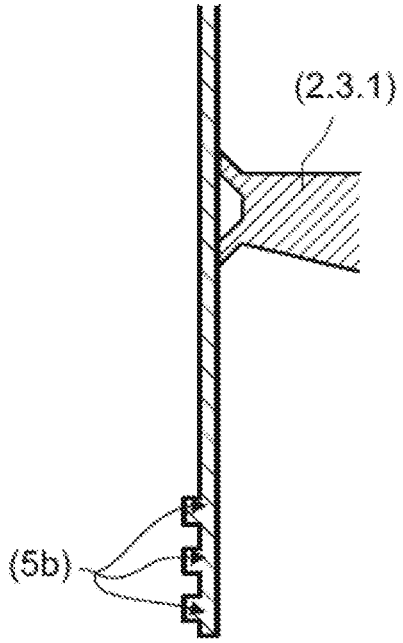
FIGS. 2*a* and 2*b* show detail views of regions of the cartridge comprising means (5*b*) for producing a reversible joint-type connection (6).
Figure 2B:
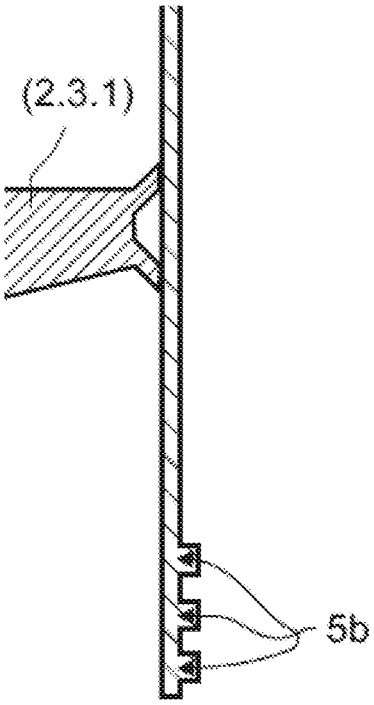
Figure 3:
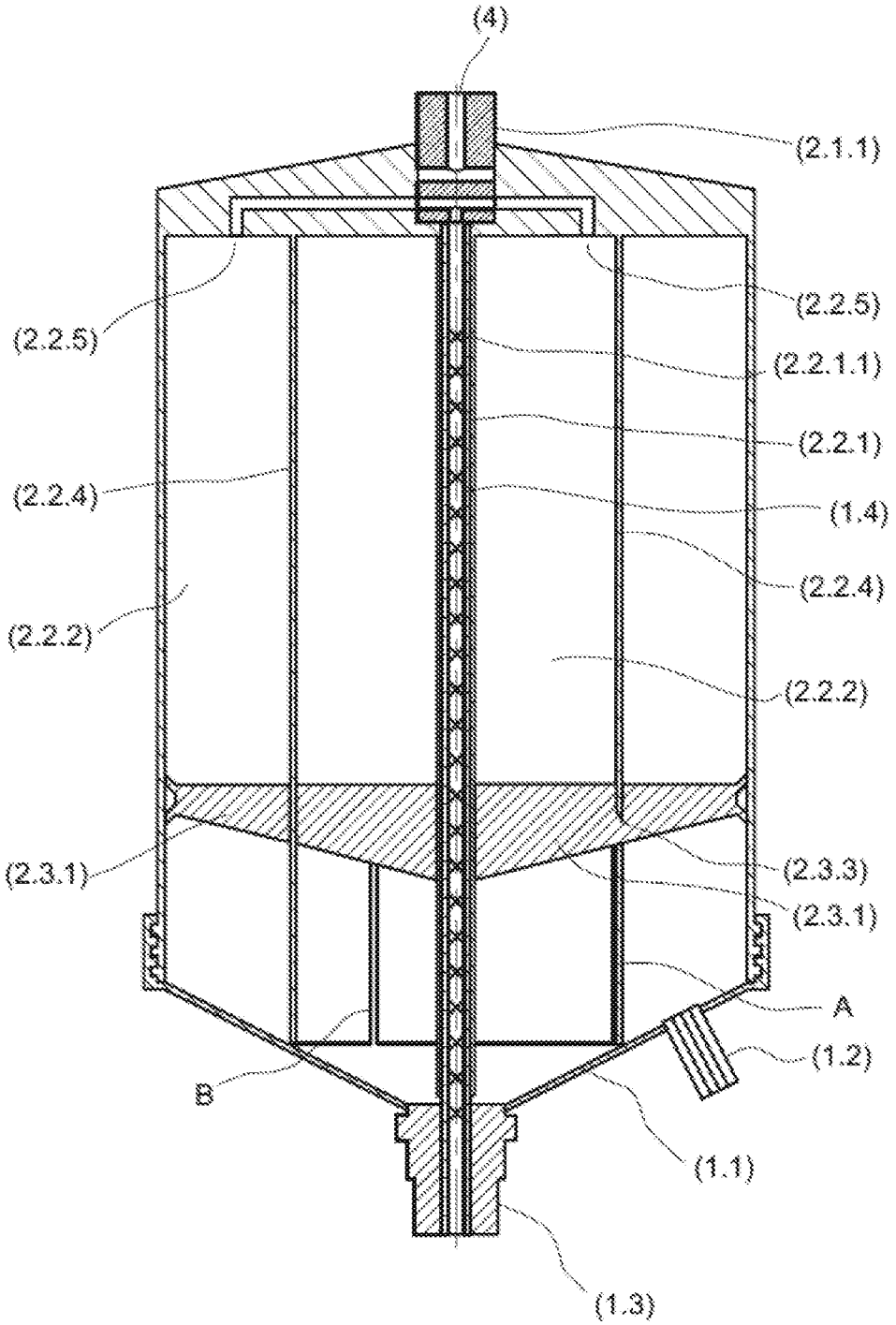
Figure 3A:
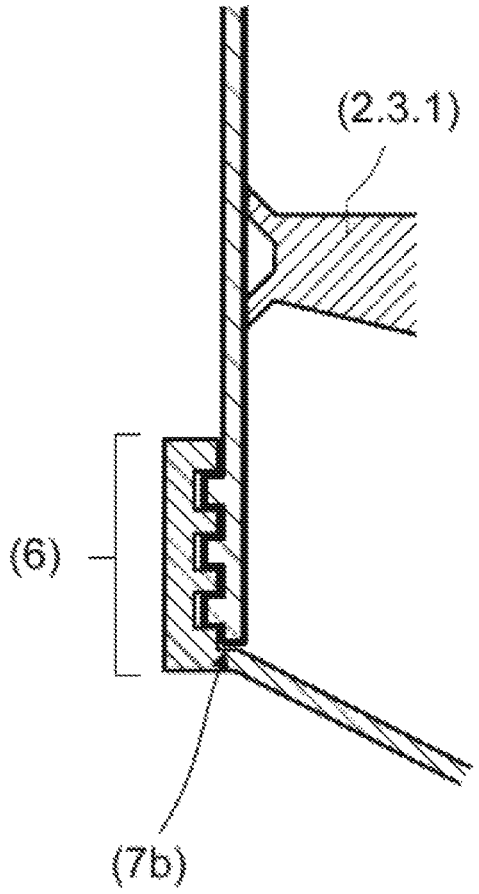
Figure 3B:
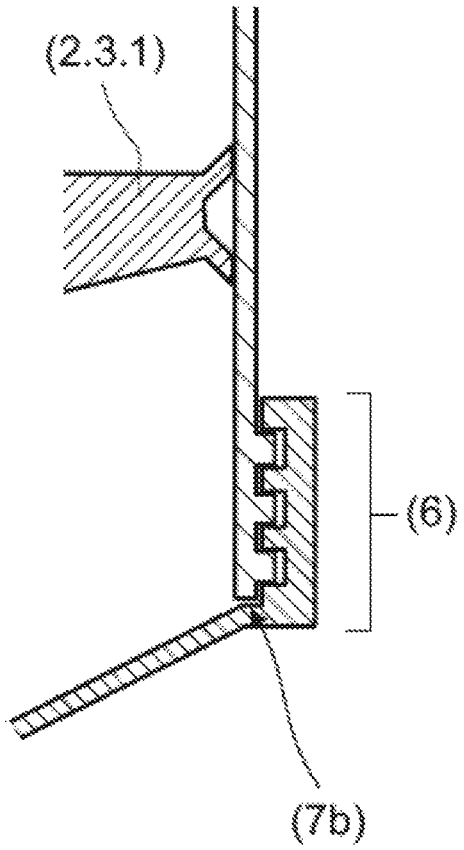

FIG. 3 shows a metering and mixing device according to the invention, which comprises the component parts described in FIGS. 1 and 2. FIGS. 3*a* and 3*b* show detail views of regions of the metering and mixing device which comprise a reversible joint-type connection (6) in the closed state. Regions of surface-to-surface positive and/or non-positive connections (7*b*) are furthermore shown.

Figure 4A:
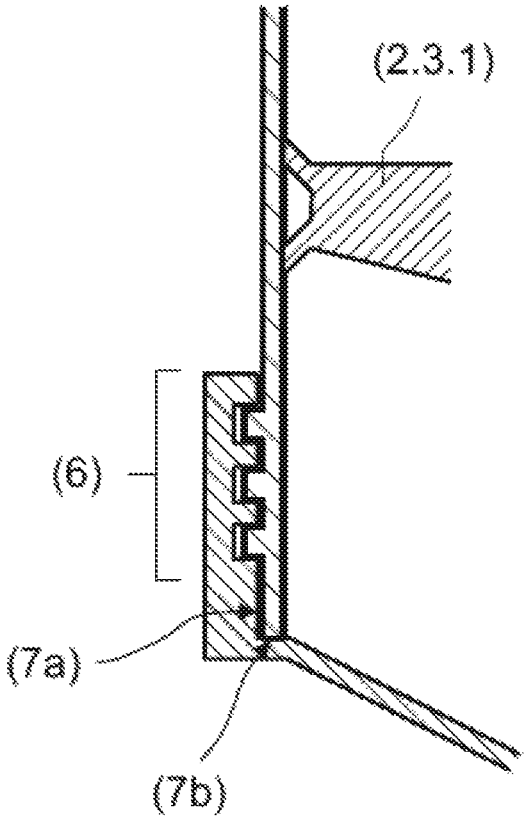
Figure 4B:
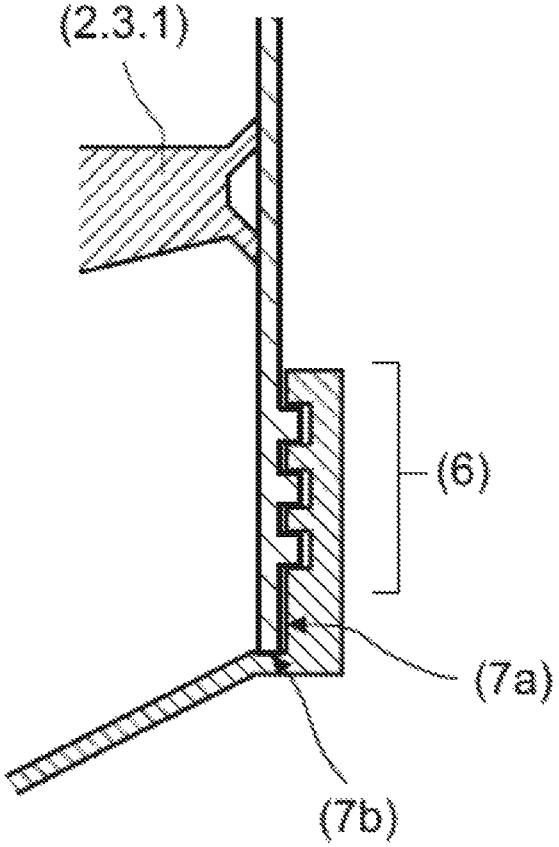

FIGS. 4*a* and 4*b* show alternative regions to those in FIGS. 3*a* and 3*b*, comprising a reversible joint-type connection (6) in the closed state. Both regions of surface-to-surface, purely positive connections (7*a*) and regions of surface-to-surface positive and/or non-positive connections (7*b*) are shown.

Figure 5:
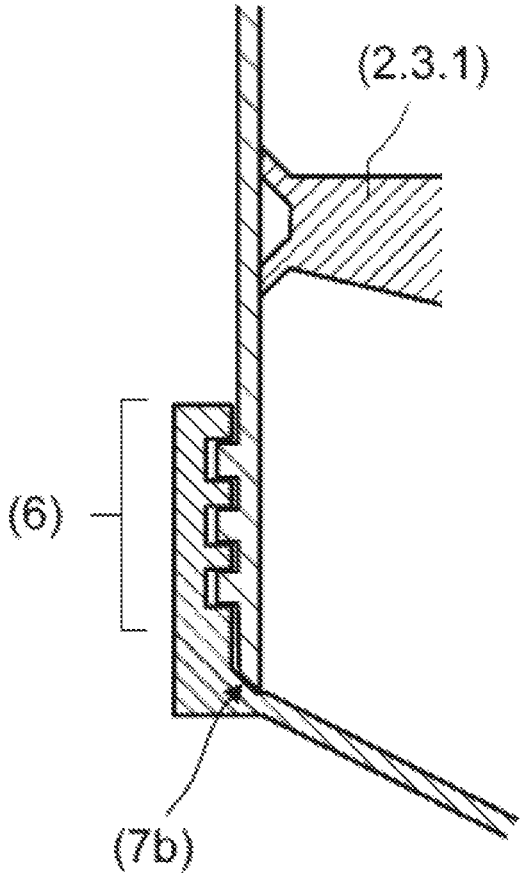

FIG. 5 likewise shows an alternative region comprising a reversible joint-type connection (6) and a region of surface-to-surface connection. Here once again, the surface-to-surface connection (7*b*) is of positive and non-positive design, wherein it is not planar (FIGS. 3*a* and 3*b*) but conical in configuration.

Figure 6:
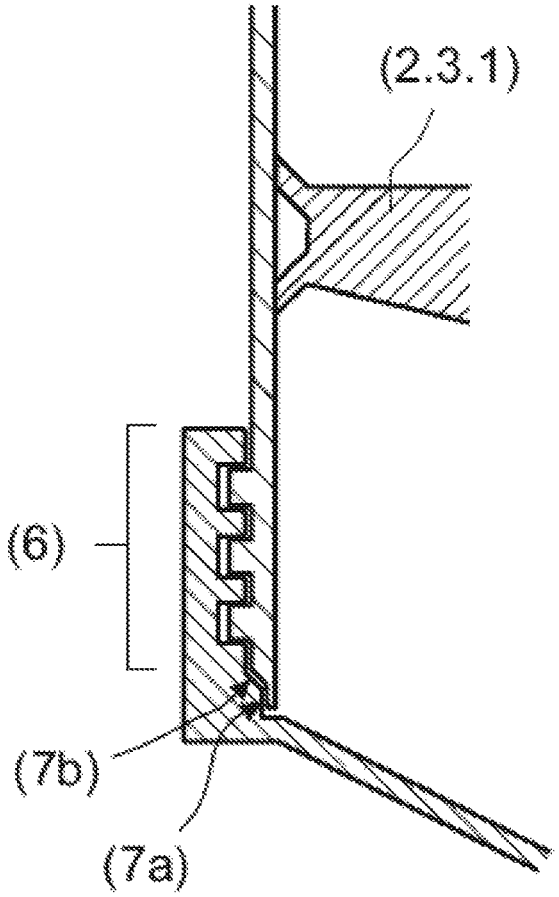

FIG. 6 also shows an alternative region of this kind. Here, both a region of surface-to-surface, purely positive connection (7*a*) and a region of surface-to-surface positive and non-positive connection (7*b*) are shown.

First of all, some of the terms used in the context of the present invention will be explained.

Where reference is made in the context of the present invention to a space extended in the direction of the longitudinal axis or to a corresponding chamber, this means that the space or chamber has the greatest extent in the direction of said axis. Here, the space or chamber can be shaped, in particular, as a cylinder or prism, in particular as a right cylinder or right prism, wherein the respective cavity present forms the space or chamber. Circular cylinders, elliptical cylinders or even ultimately prisms that are arbitrarily shaped and individually adapted in respect of their cross-sectional area are possible. Instead of a complete circular ring, segments of an imaginary circular ring are also possible as cross-sectional area geometries, for example. Thus, a cross-sectional area in the form of a circular ring can be divided into two or more segments of equal or different size and thus into different extended regions (space, chambers). Here, boundaries of the segments are formed by partition walls, e.g. partition walls of adjacent chambers. Of course, almost any other geometries can be implemented. Thus, for example, individual tubes of circular cross-sectional area can also replace the right hollow cylinders with a cross-sectional area in the form of a circular ring segment.

Where reference is made in the context of the present invention to a reversible joint-type connection, this should be taken to mean a connection between two elements which can be produced (closed) and opened (released) variably.

The production of the connection (i.e. closure) and hence, logically, also the opening of the connection (i.e. release) is achieved by means of mutually complementary means on the elements to be connected. A joint-type connection of this kind can be achieved by means of at least one bayonet joint or at least one screw-threaded joint, for example. The means for producing a joint-type connection of this kind are then attached to the elements to be connected and accordingly correspond to one another (are mutually complementary). In the case of a bayonet joint, the corresponding means are a longitudinal slot having a transverse slot, which starts at the end thereof, and a knob, which is introduced into the longitudinal slot and is then anchored in the transverse slot by a rotary motion which then follows. In the case of a screw-threaded joint, the corresponding means are threaded pieces which have a screw thread comprising at least one thread flight and a corresponding screw thread.

Even if it is fundamentally known that a bayonet joint can likewise be assigned to the group of screw-threaded joints (where the transverse slot then counts as a thread flight), a distinction is drawn between them in the context of the present invention for the sake of clarity. A joint referred to in the context of the present invention as a bayonet joint is one in which the thread flight does not have a slope in the direction of the torque of the closing direction of rotation (i.e. thread pitch=0 or even, to allow spring back and anchoring of the knob, an opposing thread pitch).

Thus, in the correspondingly narrower sense, joints in which the at least one thread flight of a screw thread has a thread flight in the direction of the torque of the closing direction of rotation are regarded as screw-threaded joints.

If two elements, in particular a cartridge and a cartridge holder, are connected by closing a joint-type connection that is reversible as described, there is a certain connection between the elements, depending on the configuration of the means (5) and the geometrical shape of the connected elements. The connection can be limited to the means (5), for example. Equally, however, there can furthermore be a connection which goes beyond the region of the means (5) and, in particular, results from the geometries of the elements to be connected. Thus, it is at least possible for there to be a surface-to-surface connection in addition. In that case, therefore, a surface of one element then rests against a surface of the other element. Of course, it is also possible in each case for a plurality of surface pairs to rest one against the other. A surface-to-surface connection as described is essential in the context of the present invention. By definition, a surface-to-surface connection of this kind is distinct from connections existing directly in the region of means (5).

A surface-to-surface connection of this kind can be of large-area configuration, for example, i.e. very large sections of the elements are connected to one another. This is the case, for example, in connection with WO 2016/020129 A1, described at the outset.

As regards the type of connection, a distinction should be made between a purely positive and a non-positive connection. When connecting two elements, it is, of course, also possible for there to be both regions (surfaces resting one against the other) with a purely positive connection (7*a*) and regions with both a positive and a non-positive connection (7*b*). Whereas, in the case of a positive connection, regions of the elements merely rest one upon the other or one against the other, there is an explicit normal force acting on the connection regions in the case of non-positive engagement. In the context of the present invention, this normal force, where present, and hence the positive engagement is preferably brought about by connecting the means (5). If, for example, two screw threads are rotated one inside the other, then, given appropriate geometries and alignment of surface areas of the elements to be connected, there can be a normal force acting in the direction of the torque of the twisting of the screw thread.

This is the case when there are element regions to be connected (surfaces resting one against the other) which are not arranged strictly parallel to the torque of the twisting of the screw threads (see also FIGS. 3*a*, 3*b*, 4*a*, 4*b*, 5 and 6).

Where reference is made in the context of the present invention to upper, central and lower sections of a cartridge, this encompasses first of all the relative arrangement of corresponding regions. However, the sections or regions per se are furthermore defined especially by means of the technical designs arranged therein (see above). Here, the individual dimensioning of the individual sections or regions is not in the first instance subject to any restrictions in principle.

Both various essential aspects of the present invention and preferred embodiments of the metering and mixing devices according to the invention are described in greater detail below.

The multichamber cartridge (2) of the metering and mixing device according to the invention is preferably embodied as a coaxial cartridge for a cartridge holder (1) of the kind defined above, wherein the cartridge comprises the following sections:

an upper section (2.1), comprising a directional control valve (2.1.1);

a central section (2.2), the center of which is designed, in the direction of the longitudinal axis, as an extended space (2.2.1) fitted with static mixing elements (2.2.1.1), and the space (2.2.1) is surrounded by at least two chambers (2.2.2), wherein the chambers are arranged so as to be extended in the direction of the longitudinal axis of the cartridge and are arranged coaxially with respect to one another and with respect to the space (2.2.1), and adjacent chambers are separated from one another by a common partition wall (2.2.4), and each chamber is connected to the upper section (2.1) by in each case at least one opening (2.2.5); and a lower section (2.3), which comprises a piston (2.3.1) for each of the chambers, wherein the pistons (2.3.1) close off the chambers (2.2.2) leaktightly from below and are connected to one another by cutting devices (2.3.3), and the cutting devices (2.3.3) are arranged in such a way that they are capable of severing the common partition wall (2.2.4) of respective adjacent chambers (2.2.2) when the pistons (2.3.1) are moved in the direction of the upper section (2.1).

Such a construction can be obtained, for example, by coaxial arrangement of three tubes or circular cylinders one inside the other. Here, the inner tube surrounds the space (2.2.1). The space between the outer surface of the inner tube and the inner surface of the central tube forms a first chamber (2.2.2) closed off in the direction of the lower section (2.3) by a piston (2.3.1) and closed off in the direction of the upper section (2.1) by an opening (2.2.5) leading to the upper section (2.1). The space between the outer surface of the central tube and the inner surface of the outer tube forms a second chamber (2.2.2) closed off in the direction of the lower section (2.3) by a further piston (2.3.1) and closed off in the direction of the upper section (2.1) by an opening (2.2.5) leading to the upper section (2.1).

In said preferred embodiments, the lateral walls of the chambers and of the space are therefore arranged coaxially. This therefore also means that, in these preferred embodiments, the surface lines of a chamber and of a space run strictly parallel. Accordingly, the space (2.2.1) and the chambers (2.2.2) are in the form of right circular cylinders arranged coaxially with one another.

However, this does not necessarily mean that the outer side wall of the cartridge must simply follow this course. On the contrary, the possibility of having demolding chamfers in this region of the cartridge is advantageous, said chamfers leading to the advantages described at the outset in connection with the production process.

As already noted above, the terms "upper", "central" and "lower" section in the first instance described only the relative arrangement of the sections. However, the fact that spaces and chambers extended in the direction of the longitudinal axis of the cartridge (2) are arranged in the central section (2.2) of the cartridge furthermore entails that this central section preferably accounts for the majority of the length of the cartridge. As a particular preference, the central section (2.2) of the cartridge (2) accounts for at least 50%, preferably at least 60%, as a further preference at least 75%, of the total length of the cartridge (2). The respective residual portion of the length, e.g. at most 50%, preferably at most 40%, as a further preference at most 25%, is then made up, in particular, of the upper section (2.1) and the lower section (2.3).

It is preferred that the cartridge (2) has a label on the large-area outer wall (side wall) thereof. As described at the outset, a label of this kind can be applied without impairing the introduction of the cartridge into the cartridge holder since, in particular, the above-described positive contact in the ultimately entire region of the large-area outer wall (side wall) of the cartridge is dispensed with.

As described above, the metering and mixing device according to the invention has a cartridge holder (1). This cartridge holder comprises a receiving container for the cartridge (2).

Ultimately, the receiving container and the shape thereof can be chosen arbitrarily as long as the type, described below in greater detail, of surface-to-surface and at least positive connection between the cartridge (2) and the cartridge holder (1) is achieved when the joint-type connection (6) is closed.

In this context, it is possible, for example, for the receiving container to cover the lateral walls of the cartridge as far as the region of the upper section (of course without resting in positive contact over the entire central section, e.g. through corresponding geometrical configuration of the outer side wall of the cartridge (2) and/or of the lateral inner wall of the holder (1) or lateral inner wall of the container (1.1)). The means (5) for producing the reversible joint-type connection (6) can then be arranged in the upper section (2.1) but also in the central section (2.2) or lower section (2.3). Of course, there can also be multiple instances of complementary means (5), and therefore the reversible joint-type connection (6) can comprise a plurality of joints, e.g. bayonet joints and/or screw-threaded joints.

However, it is preferred that the receiving container (1.1) is designed as a receiving shell. This obviously means that the receiving container (1.1) only partially covers the cartridge (2) arranged therein, that is to say preferably only the lower section (2.3) or the lower section (2.3) and a lower partial region of the central section (2.2) of the cartridge (2).

In this preferred embodiment, the means (5) for producing the reversible joint-type connection (6) are then arranged in such a way that, relative to the cartridge (2), the at least one joint is set up in a lower partial region of the central section (2.2) thereof and/or an upper partial region of the lower section (2.3) thereof. There is preferably precisely one joint.

The embodiment described (receiving shell) has particular advantages. On the one hand, the initially described introduction of the cartridge is made even easier. Even if the special nature, described below, of the surface-to-surface and at least positive connection between the cartridge (2) and the cartridge holder (1) is already sufficient to achieve advantages over the prior art, even better handling is achieved by the type of construction described. This is because only a very small quantity of air must be displaced in these embodiments as the cartridge is introduced into the holder.

Fundamentally, it is the case that the air between the cartridge and the holder is compressed during the introduction process because of the at least positive connection between the cartridge and the cartridge holder. If, however, there is a relatively large air volume before compression, the air, which is then compressed to a high pressure, must be discharged via a very difficult-to-produce topography of the cartridge holder surface over the majority of the introduction path before positive sealing takes place. The backpressure which then still arises must be overcome by the painter through the expenditure of an increased force. Alternatively, the air can be discharged via a valve in the cartridge holder, and it is then necessary to re-close this valve after introduction.

In the embodiments described above, however, only a very small air volume has to be displaced and compressed, and therefore the disadvantages enumerated in the previous paragraph do not exist.

Similar advantages apply to the already described labeling of the lateral outer wall of the cartridge (2). The construction described makes this type of labeling even easier.

Another advantage of the type of construction described for the receiving shell (1.1) results from the following circumstance. It is known that the materials used in connection with the component parts that form the subject matter here, that is to say, in particular, plastics, should generally have good mechanical and also chemical resistance. It likewise known that it is generally impossible to obtain these properties from plastics which are transparent in any layer thicknesses but are more translucent above a certain thickness. Polypropylene may be mentioned by way of example. If two walls (of the cartridge and the cartridge holder) in layer thicknesses that are sufficient in respect of the mechanical requirements are then used, visual perception of the interior pistons and hence of the level of material in the chambers is very difficult. Moreover, the double wall described results in a relatively high weight, which is less comfortable for the painter. Through the use of the above-mentioned shell (1.1), the disadvantages described in respect of a lack of visibility of the level and of high weight are avoided.

As regards the type of joint, a screw-threaded joint is preferred. This is because it is precisely a screw-threaded joint which offers particular advantages in connection with air-assisted systems such as the metering and mixing device according to the invention under consideration here. This is because, to the extent that a device that is still under pressure is to be unscrewed, it would be possible, in the case of progressive unscrewing of the joint, for the compressed air to escape at a point in time at which there was still engagement between a sufficiently large number of thread flights and corresponding thread flights and/or between a sufficiently long section of just one thread flight and a section of a corresponding thread flight, thus ensuring that the component parts to be separated did not fly apart in an uncontrolled manner. This advantage obviously does not exist as distinctly in the case of a bayonet joint. Moreover, non-positive engagement, as described below and as preferred, can be achieved in a very good and definite way by means of a screw-threaded joint.

In principle, the screw-threaded joints can be configured in any desired manner as long as the abovementioned criteria in respect of the thread pitch of the thread flights are satisfied. Thus, the screw threads of the joints can have a single flight or multiple flights. A thread flight can form one or even several complete turns. Equally, a thread flight can also form less than one turn.

In the context of the present invention, there is a preference for screw-threaded joints in which the corresponding screw threads have thread flights which form no more than one complete turn, preferably no more than half a turn, e.g. one third of a turn. This ensures very simple assembly of the metering and mixing device. In order to achieve a necessary or desirable strength of the joint-type connection, these are then preferably multi-flight screw threads. This means that a screw thread has at least two thread flights, preferably 2 or 3 thread flights. Of course, the respectively corresponding screw thread then has the corresponding number of thread flights.

According to the invention, it is envisaged that, in the closed state of the reversible joint-type connection (6), there is furthermore between the cartridge (2) and the holder (1) a surface-to-surface, at least positive connection including the entire circumference of the cartridge, which connection extends over a partial region of the upper section (2.1) and/or at least a partial region of the lower section (2.3) and/or only a partial region of the central section (2.2) of the cartridge.

How such a surface-to-surface and at least positive connection can be achieved in principle is already evident from the information mentioned above. Details and illustrative embodiments thereof are described below. At the same time, it is only the type of connection (exclusively positive or positive and non-positive) and the precise position of the surface-to-surface connection which will be explored in detail. The way the means (5) and hence the reversible joint-type connection (6) are to be arranged and/or which geometries the elements comprising the cartridge (2) and the holder (1) must have in this context, for example, can be adapted without problems in each individual case by a person skilled in the art.

Of course, there is a requirement that the connection should include the entire circumference of the cartridge. Only in this way is it possible to achieve a pressure buildup as described below. It is therefore also clear that the individual choice of a region or partial region is only possible by means of the dimensioning existing in the direction of the longitudinal axis of the cartridge. Owing to the fixed dimensioning, namely the circumference of the cartridge, and an individually selectable extent in relation to the longitudinal axis of the cartridge, a connecting surface or a surface-to-surface connecting region is obtained.

It is possible, for example, for the connection to extend over a partial region of the upper section (2.1) of the cartridge. In this case, the partial region, in particular, of the upper section which is to be assigned to the lateral walls or the encircling side wall of the cartridge would then be provided for connection to the cartridge holder, namely a partial region of the lateral inner wall of the container (1.1). This is because the upper side (end side) of the cartridge and the corresponding partial region of the upper section (2.1) is obviously unsuitable for such a connection since, to achieve this, the cartridge holder would have to be correspondingly arranged above the upper side of the cartridge, making it impossible in practice to introduce the cartridge into the holder.

It would also be possible for the connection to extend over at least a partial region of the lower section (2.3) of the cartridge. Here too, the partial region, in particular, of the lower section which is to be assigned to the lateral walls or the encircling side wall of the cartridge would then be provided for connection to the cartridge holder, namely a partial region of the lateral inner wall of the container (1.1). Admittedly, the underside of the cartridge and the corresponding partial region of the lower section (2.3) can likewise be used to produce such a connection. However, at least a complete connection on the underside does not appear to be very advantageous. This is because there should be a space for the buildup of pressure via the compressed air connection (1.2) between the underside of the cartridge (2) and the inner side of the base of the cartridge holder (1). Moreover, component parts such as the compressed air connection (1.2) and the connection for the application device (1.3) occupy a certain volume within the cartridge holder, with the result that a complete connection of the cartridge and the holder in this region would be possible only by means of an extremely complex cartridge geometry.

A surface-to-surface connection which extended only over a partial region of the central section (2.2) would likewise be possible. It is advantageous if such a connection accounts for no more than 50%, preferably no more than 25%, as a further preference no one 10%, of the total length of the section (2.2).

It is, of course, furthermore possible to implement two or more of the abovementioned connecting positions. However, it is advantageous here for the connecting surface to extend over no more than 30%, preferably no more than 15%, as a further preference no more than 5%, of the total length of the cartridge.

If more than one connecting position and hence different connecting regions are implemented in the abovementioned sense, it is obviously required that each individual region should be of surface-to-surface and at least positive design and designed so as to include the entire circumference of the cartridge. However, this does not, of course, exclude the existence of further connecting surfaces which do not include the entire circumference of the cartridge, for example. Of course, these connecting surfaces are then not connecting surfaces in the abovementioned sense and can be based, for example, on particular individual construction geometries of the cartridge and/or the holder.

In the context of the present invention, it is preferred that the surface-to-surface connection extends over an upper partial region of the lower section (2.3) of the cartridge and/or a lower partial region of the central section (2.2).

This arrangement of the surface-to-surface connection is obviously suitable as a particular preference in connection with the above-described embodiments relating to the receiving shell.

In the context of the present invention, it is fundamentally preferred that the geometrical shapes of the cartridge and the cartridge holder are configured and matched to one another in such a way that a positive connection is not established before the end of the process of introducing the cartridge into the cartridge holder. This means that, after the initial partial production of a positive connection, the cartridge does not have to be pushed further to any significant extent but must merely be brought into the end position to produce the positive connection intended overall. This ensures that, even in the case of embodiments in which the container (1.1)

is not designed as a shell, the above-described advantages in respect of avoiding a high pressure buildup due to compression of a large air volume are obtained in a form which is almost comparable. Admittedly, the shell construction has further advantages owing to an extremely simple introduction process. Nevertheless, however, good conditions are obtained even in the variant embodiment described here.

The surface-to-surface connection is at least positive ((7*a*), for the definition, see above). However, the surface-to-surface connection can furthermore be at least partially both positive and non-positive ((7*b*), for the definition, see above).

The surface-to-surface connection is preferably at least partially both positive and non-positive. This can be achieved, as described above, by means of surfaces of the cartridge (2) and of the holder (1) which rest against one another and which are not arranged strictly parallel to the torque of the twisting of the joint used, in particular preferably of the screw-threaded joint (see also FIGS. 3*a*, 3*b*, 4*a*, 4*b*, 5 and 6). In the context of the present invention, therefore, the non-positive engagement, where present, is preferably brought about by connecting the means (5).

The advantage of the at least partially both positive and non-positive connection is, in particular, that, despite the only small-area connection of the cartridge (2) and the holder (1) in comparison with the prior art, a very good, if not even better pressure buildup for moving the pistons is made possible (in this connection, see also below) and nevertheless the advantages described at the outset are maintained.

It may be explicitly mentioned that, in the context of the present invention, a positive and also non-positive surface-to-surface connection in accordance with the claims is one which exists even without the application of pressure. Pressing of the cartridge onto the holder, which may be obtained by applying pressure and which, in particular, can arise in the region of purely positive regions (7*a*), is not comparable to an actual non-positive connection.

For all embodiments of the cartridges, it is the case that, for use as delivery, metering and mixing units, these preferably contain different components to be mixed in the individual chambers, especially components which can react with one another after being mixed or should be stored separately for other reasons. Thus, for example, masterbatches and the hardeners thereof, or low-viscosity liquids which build up a higher viscosity or thixotropy only after being mixed can be stored separately in the chambers of the cartridges. However, it is also possible to mix components of different colors, e.g. a black filler component and a white filler component in this way to give a gray mixture.

By virtue of the fact that the volumes of the chambers can be selected freely when producing the cartridges, the components to be mixed can be stored separately from one another in the quantity ratios required for subsequent use. In the case of the preferred coaxial cartridges, the volumes of the chambers are determined by means of the diameters of the tubes. For all the embodiments, it is the case that the volume flows of the components, e.g. of the masterbatch and hardener, are fed separately to the directional control valve (2.1.1) of the upper section (2.1). As a particular preference, the directional control valve (2.1.1) is a 3/2-way valve (2.1.1). In a preferred embodiment, the directional control valve (2.1.1) or 3/2-way valve (2.1.1) can also have a premixing chamber which is integrated into the directional control valve (2.1.1) and in which the initially separate volume flows of the components can meet and mix. If the directional control valve (2.1.1) is in the "metering/mixing" position, i.e. in the working position, the components, which are either in premixed form in the premixing chamber integrated into the directional control valve (2.1.1) or in largely unmixed form where there is no such premixing chamber, are fed to the actual mixing section. The extended space (2.2.1) fitted with static mixing elements (2.2.1.1) is used as a mixing section. Here, the entire space (2.2.1) can have static mixing elements (2.2.1.1). However, it is also possible, for example, for there to be a premixing section free from mixing elements and for the components, which are then premixed, to be fed to the region fitted with mixing elements only afterwards. It is equally possible to integrate the mixing elements directly from the front region of the space (2.2.1) but to embody a rear region of the space (2.2.1) without mixing elements.

The components are fed to the directional control valve (2.1.1) by means of the pistons (2.3.1), which close off the chambers from below. In this case, the pistons (2.3.1), which are pneumatically driven, force the corresponding components out of their chambers into the upper section (2.1) of the multichamber cartridge (2). During this process, the partition wall (2.2.4) between the chambers is severed by the cutting device (2.3.3) connecting the pistons (2.3.1), thereby making possible further emptying of the chambers only at this stage. In all the embodiments, the cutting device (2.3.3) connects the pistons (2.3.1) serving as the base of the chambers, thereby also ensuring that the pistons (2.3.1) are moved simultaneously when subjected to pressure and thus that the components are forced out of the chambers in the same ratio as the sizes of the chambers relative to one another, even in the case of components of widely differing viscosity, and thus in a manner independent of viscosity. Emptying therefore takes place in the volumes determined by the size of the chambers and thus in the desired proportions. After optional premixing in the premixing chamber that may be integrated into the above-described directional control valve (2.1.1) in the upper section (2.1) of the cartridge, the components are forced through the static mixing elements (2.2.1.1) and homogeneously mixed in the process.

After leaving the chambers (2.2.2) through the openings (2.2.5), the components stored in the separate chambers can thus come into contact with one another either already in a premixing chamber integrated into the directional control valve (2.1.1) of the upper section (2.1), in a section that may be present between the directional control valve (2.1.1) and the first static mixing elements (2.2.1.1) or upon contact with the static mixing elements (2.2.1.1).

In a special embodiment of the present invention, the mixing described is achieved by means of static mixing elements in the form of a mixing tube with fixed internal fittings. "Mixer rods" can preferably be used. Examples of mixer rods that are very particularly preferred can be obtained from Fluitec Georg AG (Neftenbach, Switzerland) under the name CSE-X® mixers or from Industra GmbH (Heusenstamm, Germany) under the name "mixing element" with the item number 205059 (76-104).

The cartridge holder (1) has a compressed air connection (1.2), which is preferably arranged on the base of the receiving container (1.1), and a connection (1.3) for an application device. The compressed air connection (1.2) is positioned in such a way that the compressed air which flows in during operation moves the pistons (2.3.1) serving as bases of the chambers, with the result that the components can be forced out of the chambers.

The cutting device (2.3.3) for severing the wall between two adjacent component chambers (2.2.2) is preferably designed as a wedge-shaped gap, similarly to open shears. It is thereby possible to prevent material compression during the cutting of the partition walls and, at the same time, to reduce the cutting force.

The components to be mixed transferred to the mixing section and hence to the extended space (2.2.1) must of course be fed to the application device after being mixed. This obviously takes place via the connection (1.3). Accordingly, the mixed components are fed to the connection (1.3), e.g. via an extension of the preferably cylindrical (tubular) space (2.2.1) into the lower section of the cartridge and fluid-carrying connection of said space to the connection (1.3).

Connecting the connection (1.3) on the base of the receiving shell (1.1) of the cartridge holder (1) to an application device is unproblematic and can be accomplished with all common connecting means, e.g. by means of a screw thread or quick action couplings or dovetail connections. It is also possible to integrate static mixing elements into the connection (1.3) itself and/or to position therein the static mixing elements (2.2.1.1) of the space (2.2.1), which is extended as far as the connection (1.3).

In principle, any type of application device is suitable as an application device. The application devices are used to apply the mixed components, these preferably being coating media such as paints, putties, sealing compounds or adhesives, to substrates. Thus, for example, sponges, brushes, rollers, doctor blades or nozzles of many different types, e.g. flat jet nozzles, wide jet nozzles, wide slot nozzles, multichannel (fan) nozzles or round jet nozzles, wherein the nozzles can be used with or without atomizing air. Spray guns, preferably those for the spray application of coating media compositions, are a very particularly preferred application device.

In principle, all spray guns which are used in compressed-air spraying are suitable as spray guns. Connecting the connection (1.3) on the base of the receiving container (1.1) of the cartridge holder (1) to the spray gun is unproblematic and can be accomplished with all common connections, preferably by means of a screw thread or quick action couplings or dovetail connections. Paint spray guns can be obtained from Sata GmbH & Co. KG (Kornwestheim, Germany) under the name SATAjet®, in the form of HVLP or RP spray guns, for example.

All component parts and materials of the metering and mixing device are chosen in such a way that they are designed for the occurring pressures and their envisaged function and are very largely chemically inert relative to the components to be mixed and those which have been mixed. In particular, polypropylenes are used for the walls of the chambers or extended spaces. Polyethylenes and/or composite materials are generally suitable as pistons (2.3.1), and polycarbonate and/or polyoxymethylenes are generally suitable as materials for the cutting device (2.3.3). However, the metering and mixing device and the constituent parts thereof are not restricted to these materials. Thus, it is also possible, in particular, for metals to be used, e.g. for the embodiment of the cutting device (2.3.3), or coated materials in order to make possible inert behavior relative to any chemically aggressive components, for example.

The cleaning of the metering and mixing devices according to the invention can be accomplished in a simple manner via the directional control valve (2.1.1), wherein the multichamber cartridge (2) can remain in the receiving container (1.1) during cleaning. For this purpose, the directional control valve (2.1.1) situated in the upper section (2.1) of the multichamber cartridge (2) is moved out of its "metering/mixing" operating position into the "flushing" cleaning position. In the "metering/mixing" operating position, the components can be forced out of the chambers into the directional control valve (2.1.1), while the flushing connection (4) is simultaneously shut off, whereas, in the "flushing" cleaning position, the supply of the components from the component chambers is interrupted and the central mixing channel can be connected to a flushing connection (4). Flushing is performed with a flushing medium, preferably with commercially available solvents and/or water, wherein the flushing medium can contain additional detergents and/or other typical cleaning agent additives as far as desired or required. Flushing can be performed with or without air pulses. The flushing medium should be capable of dissolving the components of the multicomponent system and any reaction products as completely as possible. During the flushing process, the flushing medium is passed through the static mixing elements in order to free these elements from the adhering component mixture and any reaction products that may already have formed. After cleaning, the multichamber cartridge (2) can be removed from the metering and mixing device without problems and stored.

The present invention also relates to a method for delivering, metering and mixing two or more components, preferably paint components, adhesive components or sealant components, particularly preferably paint components, which makes use of the metering and mixing device according to the invention.

Furthermore, the present invention relates to a method for coating substrates with two-component (2C) or multicomponent coating media using the metering and mixing device according to the invention in combination with an application device, preferably a paint spray gun. It is particularly advantageous if the method according to the invention for coating is carried out in a purely manual way. In particular, the method according to the invention is suitable for coating using small quantities of paint. The method is preferably carried out as an HVLP spraying method or as an RP spraying method. As a very particular preference, it is used in automotive refinishing. However, the abovementioned method can also be used in the context of initial OEM coating, especially during "assembly refinishing".

In a special embodiment, the method according to the invention for coating substrates with two-component (2C) or multicomponent coating media using the metering and mixing device according to the invention in combination with an application device comprises a flushing step. In this variant of the method, the application of the 2C or multicomponent coating medium is interrupted once or several times, the multichamber cartridge (2) is cleaned during the interruption of the application, and the application is continued after the cleaning of the multichamber cartridge (2), using the same multichamber cartridge (2) or a different multichamber cartridge (2) according to the invention. During cleaning, the static mixing device, i.e. the space (2.2.1) and the mixing elements (2.2.1.1), arranged therein, of the metering and mixing device according to the invention are flushed.

If the method is carried out as an HVLP spraying method, the atomization pressure is generally 1.5 to 2 bar. In the case of RP guns, operations are generally carried out at an atomization pressure of 1.5 to 3 bar.

If two components are used, one component can be a "masterbatch", for example, and the second component can be a hardener matched to the masterbatch. Hydroxy-functional polymers, e.g. polyhydroxy-functional poly(meth) acrylates, polyesterpolyols, polyetherpolyols, polyurethane polyols or mixed polyester/polyetherpolyols are preferably used in the masterbatches. Polythiols can also be used, for example. In the hardener components, it is customary to use polyisocyanates, such as hexamethylene diisocyanate, toluylene diisocyanate, isophorone diisocyanate or diphenylmethane diisocyanate, or the dimers, trimers and polymers of the abovementioned isocyanates, and/or aminoplast resins, e.g. melamine resins. It is likewise possible to use epoxy systems, in both conventional and aqueous form. Of course, it is also possible to use systems which become reactive only in contact with atmospheric moisture (e.g. aldimines and silanes). In general, however, it is the case that the masterbatch and the hardener contain compounds with mutually complementary functional groups. That is to say groups which enter into reaction with one another after the mixing of the two components. For example, the following complementary groups may be mentioned: amine/isocyanate, hydroxy/isocyanate, thiol/isocyanate, amine/epoxy resin/isocyanate, amine/epoxy resin, epoxy resin/anhydride, epoxy resin/carboxy, amine/anhydride, anhydride/hydroxy, hydroxy/isocyanate/amine or carbodiimide/carboxy, thiol/ene, amine/cyclocarbonate, hydroxy/cyclocarbonate, amine/hydroxy/cyclocarbonate, alpha, beta unsaturated carbonyl/amine and/or thiol, oxazoline/carboxy, silane/silane, silane/hydroxy groups. Normally, the masterbatch and the hardener react after application at temperatures of 0 to 100° C., preferably 10 to 80° C., i.e. under conventional refinish coating conditions.

In the method according to the invention, it is also possible to choose masterbatch/hardener combinations which have pot lives that are too short in a conventional procedure of premixing the components before filling the paint storage container. Even in such systems, outstanding coatings distinguished by short drying and hardening times and an outstanding appearance are obtained.

The invention claimed is:

1. A metering and mixing device comprising:

i. a cartridge holder comprising (a) a receiving container for multichamber cartridges, and (b) a compressed air connection and a connection for an application device, and ii. a multichamber cartridge inserted into the cartridge holder according to i., wherein said multichamber cartridge comprises the following sections: an upper section, comprising a directional control valve; a central section, a center of which is designed as a space which is extended in a direction of a longitudinal axis of the multichamber cartridge and is fitted with static mixing elements, and the space is surrounded by at least two chambers, wherein the chambers are arranged so as to be extended in the direction of the longitudinal axis of the multichamber cartridge, and adjacent chambers are separated from one another by a common partition wall, and each chamber is connected to the upper section by in each case at least one opening; and a lower section, which comprises a piston for each of the at least two chambers, wherein the pistons close off the at least two chambers leaktightly from below and are connected to one another by cutting devices, and the cutting devices are arranged in such a way that they are capable of severing the common partition wall of respective adjacent chambers when the pistons are moved in a direction of the upper section, wherein the multichamber cartridge and the cartridge holder have mutually complementary means for producing a reversible joint-type connection between the multichamber cartridge and the cartridge holder, and wherein a surface-to-surface, at least positive connection including an entire circumference of the multichamber cartridge, which extends over a partial region of the upper section and/or at least a partial region of the lower section and/or only a partial region of the central section of the multichamber cartridge, furthermore exists between the multichamber cartridge and the cartridge holder in a closed state of the reversible joint-type connection.

2. The metering and mixing device according to claim 1, wherein the multichamber cartridge is embodied as a coaxial cartridge and comprises the following sections:

the upper section, comprising the directional control valve;

the central section, the center of which is designed, in the direction of the longitudinal axis, as an extended space fitted the static mixing elements, and the space is surrounded by the at least two chambers, wherein the at least two chambers are arranged so as to be extended in the direction of the longitudinal axis of the multichamber cartridge and are arranged coaxially with respect to one another and with respect to the space, and the adjacent chambers are separated from one another by the common partition wall, and each chamber is connected to the upper section by in each case the at least one opening; and the lower section, which comprises the piston for each of the at least two chambers, wherein the pistons close off the at least two chambers leaktightly from below and are connected to one another by the cutting devices, and the cutting devices are arranged in such a way that they are capable of severing the common partition wall of respective adjacent chambers when the pistons are moved in the direction of the upper section.

3. The metering and mixing device according to claim 2, wherein the coaxial cartridge has a tubular space and the at least two chambers, and the space and the chambers are formed by a coaxial arrangement of three tubes, wherein an inner tube surrounds the tubular space, an outer surface of the inner tube and an inner surface of a central tube form a first chamber of the at least two chambers, which is closed off in a direction of the lower section by a first piston and is closed off in the direction of the upper section by the at least one opening leading to the upper section, and an outer surface of the central tube and an inner surface of an outer tube form a second chamber of the at least two chambers, which is closed off in the direction of the lower section by a second piston and is closed off in the direction of the upper section by the at least one opening leading to the upper section.

4. The metering and mixing device according to claim 1, wherein the space also extends through the lower section of the multichamber cartridge and has a fluid-carrying connection to the connection.

5. The metering and mixing device according to claim 1, wherein the cutting devices are embodied in a form of wedge-shaped gaps.

6. The metering and mixing device according to claim 1, wherein a premixing chamber is integrated into the directional control valve.

7. The metering and mixing device according to claim 1, wherein the central section of the multichamber cartridge accounts for at least 60%, of a total length of the multichamber cartridge.

8. The metering and mixing device according to claim 1, wherein the receiving container of the cartridge holder is designed as a receiving shell, and the cartridge holder thus only partially covers the multichamber cartridge arranged therein.

9. The metering and mixing device according to claim 8, wherein the cartridge holder covers only the lower section or the lower section and a lower partial region of the central section of the multichamber cartridge.

10. The metering and mixing device according to claim 8, wherein the means for producing the reversible joint-type connection are arranged in such a way that, relative to the multichamber cartridge, at least one joint is set up in a lower partial region of the central section thereof and/or an upper partial region of the lower section thereof.

11. The metering and mixing device according to claim 1, wherein the multichamber cartridge has a label on a large-area outer wall thereof.

12. The metering and mixing device according to claim 1, wherein the surface-to-surface, at least positive connection including the entire circumference of the multichamber cartridge extends over an upper partial region of the lower section of the multichamber cartridge and/or a lower partial region of the central section.

13. The metering and mixing device according to claim 1, wherein a surface of the surface-to-surface, at least positive connection including the entire circumference of the multichamber cartridge extends over no more than 30%, of the total length of the multichamber cartridge.

14. The metering and mixing device according to claim 1, wherein the surface-to-surface, at least positive connection including the entire circumference of the multichamber cartridge is at least in part both positive and nonpositive.

15. A method for delivering, metering and mixing two or more components, characterized in that the metering and mixing device according to claim 1 is used to carry out the method.

16. A method for coating substrates with two- or multi-component coating media, characterized in that, to apply a coating, the metering and mixing device according to claim 1 is connected to a paint spray gun, two or more components are delivered pneumatically into the upper section of the metering and mixing device and delivered in an opposite direction through the static mixing elements, being mixed in the process, and a resulting homogeneous mixture of the two or more components is then fed to the paint spray gun and applied via the paint spray gun to the substrate.

17. The method according to claim 16, wherein application is interrupted once or several times, the multichamber cartridge is cleaned during interruption of the application, and the application is continued after cleaning of the multichamber cartridge, using the same multichamber cartridge or a different multichamber cartridge of identical construction.

* * * * *